United States Patent [19]

Grove

[11] Patent Number: 4,602,448

[45] Date of Patent: Jul. 29, 1986

[54] LIGHTED DISPLAY PANEL SYSTEM

[76] Inventor: Harry R. Grove, 447 Lombrano, San Antonio, Tex. 78207

[21] Appl. No.: 587,900

[22] Filed: Mar. 9, 1984

[51] Int. Cl.[4] ..... G09F 13/00

[52] U.S. Cl. ..... 40/541; 40/605; 40/573; 362/97; 362/33; 362/224; 362/219; 362/260; 339/22 R

[58] Field of Search ..... 40/573, 571, 541, 551; 362/217, 219, 221-227, 97, 33, 260, 311; 339/20, 21 R, 22 R, 22 B, 23, 17 M, 198 G, 198 GA, 198 H, 198 K, 198 S, 198 P

[56] References Cited

U.S. PATENT DOCUMENTS

| | | | |
|---|---|---|---|
| 1,192,982 | 8/1916 | Bristol et al. | 339/22 R |
| 1,760,767 | 5/1930 | Müller | 40/541 |
| 1,844,097 | 2/1932 | Luhman | 40/573 |
| 1,858,755 | 5/1932 | Wyck et al. | 40/573 |
| 1,914,074 | 6/1933 | Bruijnes et al. | 339/21 R |
| 2,197,946 | 4/1940 | Simpson | 362/226 |
| 2,220,618 | 11/1940 | Tschopp | 339/21 R |
| 2,602,252 | 7/1952 | Shinn | 362/97 |
| 2,798,172 | 7/1957 | Jones | 339/22 R |
| 3,005,131 | 10/1961 | Melcher et al. | 339/17 M |
| 3,113,248 | 12/1963 | Friedman | 339/17 M |
| 3,237,341 | 3/1966 | Janning | 40/541 |
| 3,243,587 | 3/1966 | Relich | 362/226 |
| 3,489,981 | 1/1970 | Corl et al. | 339/21 R |
| 3,503,032 | 3/1970 | Routh et al. | 339/21 R |
| 3,748,455 | 7/1973 | Welton | 40/605 |
| 4,203,639 | 5/1980 | Vandenhoek et al. | 362/33 |
| 4,235,495 | 11/1980 | Propst et al. | 339/23 |
| 4,367,417 | 1/1983 | Casasanta | 362/225 |
| 4,388,675 | 6/1983 | Lewin | 362/225 |

FOREIGN PATENT DOCUMENTS

| | | | |
|---|---|---|---|
| 31609 | 12/1933 | Netherlands | 40/573 |
| 447844 | 5/1956 | United Kingdom | 40/541 |

*Primary Examiner*—Robert Peshock
*Assistant Examiner*—J. R. Hakomaki
*Attorney, Agent, or Firm*—Gunn, Lee & Jackson

[57] ABSTRACT

A lighted display panel system including apparatus for distributing fluorescent light through a lens having a transparency thereon. The apparatus comprises an open-sided housing having a cavity therein for receiving a plurality of fluorescent bulbs in spaced proximity to an undulant reflector. The undulant reflector is located within the housing cavity and specifically designed to provide an optimal Kelvin rating as the fluorescent light from the bulbs is reflected therefrom and passes through the lens covering the housing cavity. The apparatus is incorporated into the lighted display system by a plurality of connection bars, connection rods, and an electrical buss bar. A method of assembling the lighted display panel system is also disclosed.

2 Claims, 6 Drawing Figures

LIGHTED DISPLAY PANEL SYSTEM

BACKGROUND OF THE INVENTION

The present invention relates to a lighted display panel system which may be utilized in an exhibit booth or other form of lighted display or advertising. The system includes lighted display apparatus, connection bars, connection rods, and a buss bar which combine to minimize the space requirements typically associated with exhibit booths or display advertising.

BRIEF DESCRIPTION OF THE PRIOR ART

The use of fluorescent light to backlight or illuminate a color transparency is well known in the art. In a typical embodiment, fluorescent bulbs are placed within a type of box behind a glass panel which is secured to the box and has a color transparency thereon.

Fluorescent light has been found to provide the best and safest light source to obtain a desired Kelvin rating. Kelvin rating refers to the quality or temperature of light necessary for transparencies to exhibit maximum quality. Furthermore, the light diffusing lens or panel upon which the color transparency is placed is preferably a milk white plastic (formula 2447) developed by Rohm & Haas Company. Despite the development of the formula 2447 plastic, however, the achievement of an optimal Kelvin rating has heretofore required that the fluorescent light source be placed a sufficient depth behind the transparency to allow the hot spots from the bulbs or tubes to diffuse over the lens surface. Furthermore, space has become a premium in exhibit booths and other forms of display advertising.

The present invention provides an apparatus which reduces the minimum depth requirements between the bulbs and the lens and eliminates the appearance of hot spots or areas of high light intensity on the lens. The invention apparatus thus provides an optimal Kelvin rating and a uniform and desirable light intensity profile through the lens. Furthermore, the apparatus is readily incorporated into an invention lighted display panel system which permits the coordinated assembly of an array of such apparatus in a compact area.

SUMMARY OF THE INVENTION

It is a primary object of the present invention to provide a lighted display panel apparatus adapted to provide a uniform light intensity profile through a lens having a transparency thereon.

It is another object of the present invention to provide a lighted display panel apparatus wherein an optimal Kelvin rating is achieved and the distance or depth between the lens and the fluorescent bulbs or tubes is significantly reduced.

It is yet another object of the present invention to provide a lighted display panel system including apparatus for distributing light through a lens having a transparency thereon, a plurality of connection bars, connection rods, and an electrical buss bar.

It is a further object of the present invention to provide a lighted display panel system which permits the coordinated assembly of an array of lighted display panel apparatus in a compact area.

It is yet a further object of the present invention to provide a method of assembling the lighted display panel system.

These and other objects as well are achieved in the present invention by means of a lighted display apparatus comprising a housing having a cavity therein adapted to receive an undulant reflector and a plurality of fluorescent bulbs which are located between the reflector and a removable lens covering the housing cavity. The undulant reflector is designed to provide an optimal Kelvin rating and minimize the depth requirements between the lens and the bulbs, thereby providing a uniform intensity profile as the fluorescent light passes through the transparency on the lens.

The apparatus is provided with tabs or buttons on the sides of the housing which are adapted to be received within the grooves of a connection bar, thereby permitting the attachment of a plurality of apparatus. The connection bars are adapted to receive connection rods therethrough which may be secured to an electrical buss bar. The lighted display panel apparatus, connection bars, connection rods, and buss bar thus permit the coordinated and ready assembly of an array of apparatus in a compact area.

The method of assembling the display panel system includes the steps of inserting a connection rod into an orifice on the buss bar, inserting the connection rod through the hollow passage within a connection bar, and connecting the housings to the connection bar. By repeating these steps, the desired number of housings may be connected in horizontal alignment parallel to the buss bar, the connection rods permitting the housings to be connected in vertical alignment perpendicular to the buss bar.

DETAILED DESCRIPTION OF THE PREFERRED EMBODIMENT

Figure 1:
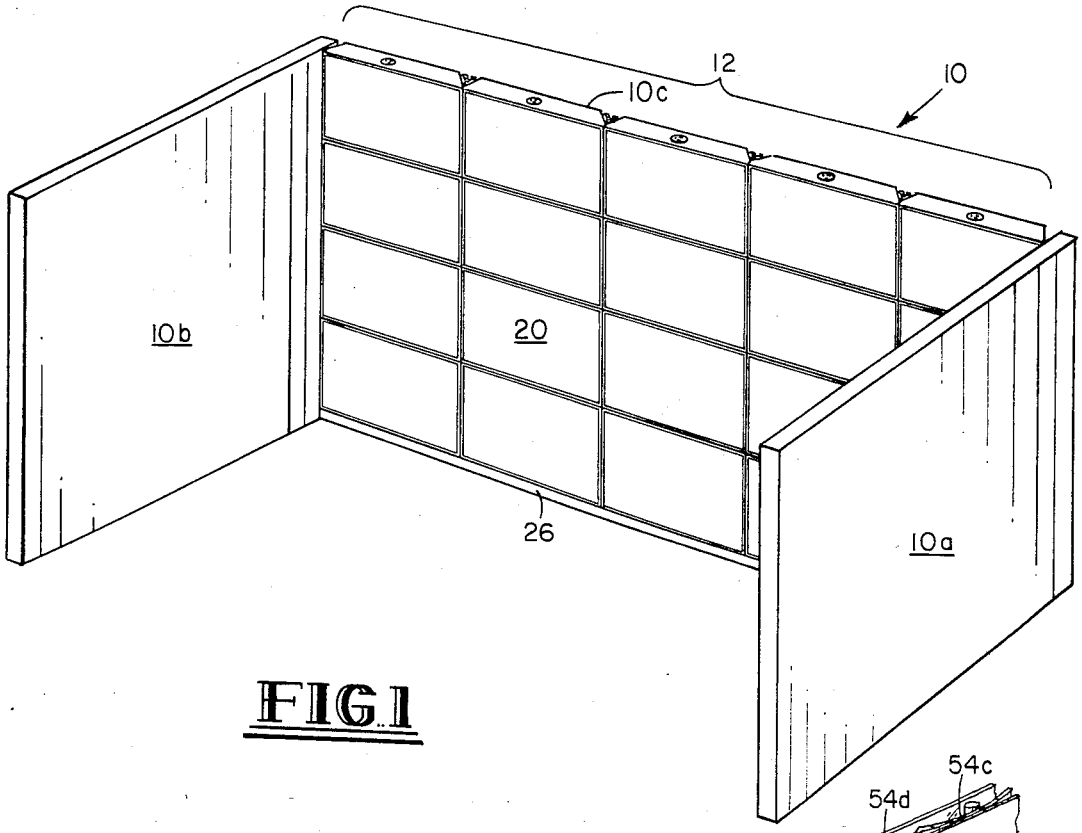
FIG. 1 is a perspective view of an assembled display booth incorporating the invention lighted display panel system.
Figure 2:
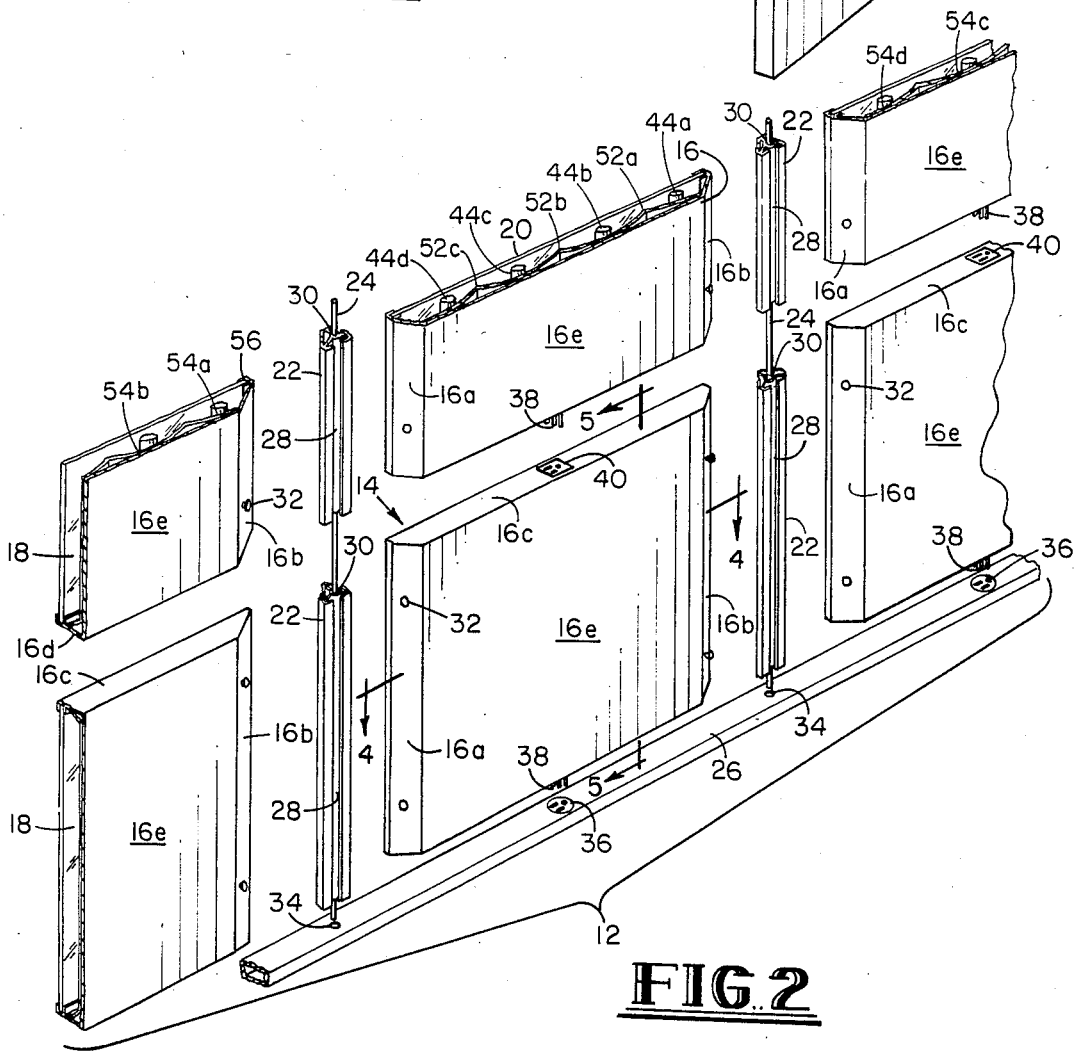
FIG. 2 is an exploded perspective view of the invention lighted display panel system.

Referring to FIG. 1, the number 10 identifies an exhibit or display booth incorporating the invention lighted display panel system 12, shown in greater detail in FIG. 2. The exhibit booth 10 includes side walls 10*a*, 10*b*, and a rear wall 10*c*. As illustrated in FIG. 1, rear wall 10*c* is formed or defined by the lighted display panel system 12. It is to be understood, however, that the display system 12 may also form, define, and/or be incorporated into side walls 10*a* and/or 10*b* or any other type of lighted display or advertising.

Figure 6:
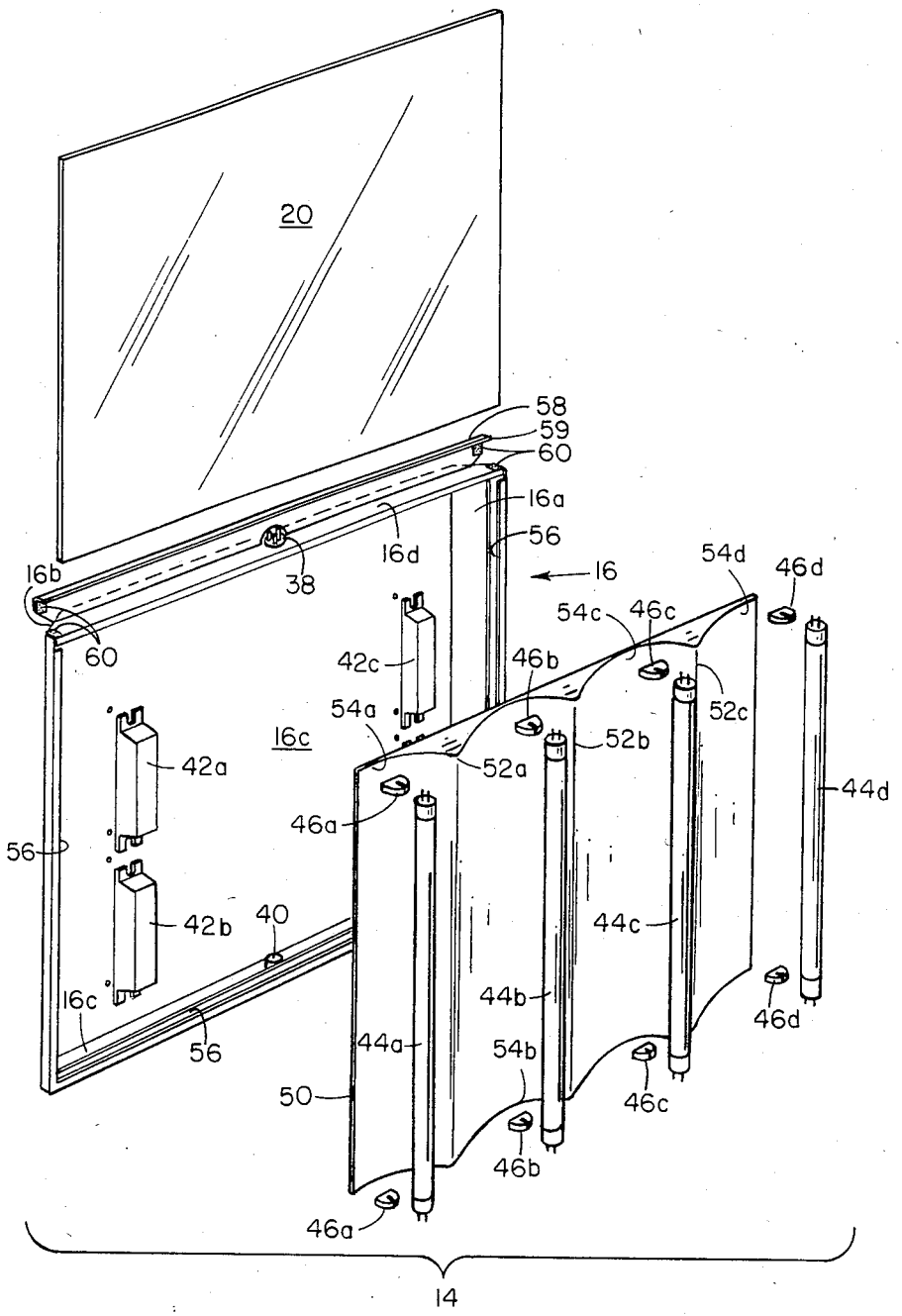
FIG. 6 is an exploded perspective view of the invention lighted display panel apparatus.

As illustrated in FIG. 2, the lighted display panel system 12 includes lighted display apparatus 14, shown in greater detail in FIG. 6. The invention lighted display apparatus 14 comprises an open-sided housing 16 having angled side walls 16*a*, 16*b*, top side wall 16*c*, bottom side wall 16*d*, and a planer rear wall 16*e*. The rear wall 16*e* and respective side walls of housing 16 form a cavity 18 which may be covered by a lens or panel 20 having a transparency (not shown) thereon. As explained in greater detail hereinbelow, panel 20 may be removably secured to housing 16. and thereby enclose cavity 18.

As further illustrated in FIG. 2, the lighted display panel system 12 preferably includes a plurality of lighted display apparatus 14, a plurality of connection bars 22 for connecting the respective apparatus 14 adjacent to side walls 16*a* and 16*b*, a plurality of connection rods 24 for connecting the respective apparatus 14 adjacent to top side walls 16*c* and bottom side walls 16*d*, and an electrical buss bar 26 for providing electrical power to the system 12 and individual apparatus 14. As explained hereinbelow, the apparatus 14, bars 22, rods 24, and buss bar 26 permit the assembly of an exhibit booth 10, such as that shown in FIG. 1, or other form of display advertising.

Figure 3:
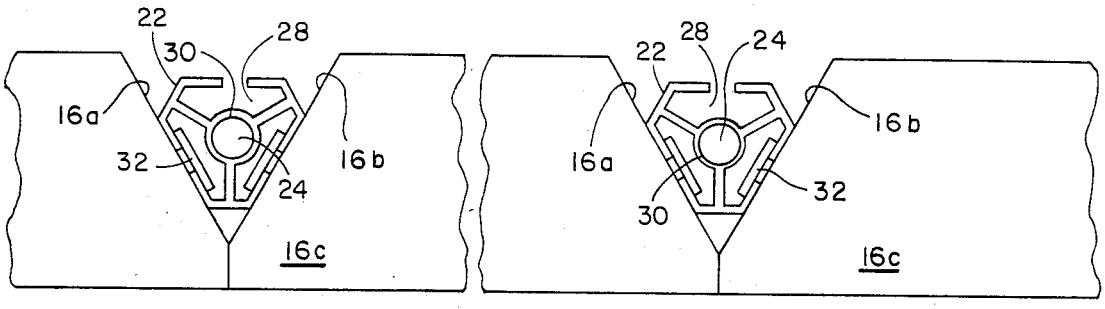
FIG. 3 is a top cutaway plan view of the invention lighted display panel system.

As illustrated in FIG. 2 and FIG. 3, each of the connection bars 22 are provided with a groove 28 on each of the three sides thereof which extend the length of the bar 22. The connection bars 22 are also provided with a hollow passage 30 which extends the length of the connection bar 22 through the center thereof and is adapted to receive connection rod 24 therethrough. As illustrated in FIG. 3, the grooves 28 and connection bars 22 are adapted to receive a plurality of T-shaped buttons or clips 32 which are appropriately connected to side walls 16*a* and 16*b* of housing 16.

The method of assembling the lighted display panel system 12 is illustrated most clearly in FIG. 2. The method of assembly comprises the steps of inserting connection rod(s) 24 through the passage(s) 30 of connection bar(s) 22. It is to be understood that the length of the connection rods 24 and the number of connection bars 22 to be placed in vertical alignment will depend upon the desired vertical height of the assembled lighted display panel system 12. The buss bar 26 is provided with a plurality of orifices 34 which are adapted to receive the lower ends of rods 24. The buss bar 26 is also provided with a plurality of female outlet plugs 36 which are adapted to receive the male connector plugs 38 located in approximately the center of bottom side wall 16*d*. The buss bar 26 thus forms the horizontal bottom or base of the lighted display panel system 12, as illustrated in FIG. 1, while the connection bars 22 and rods 24 form vertical supports for the system 12, as further illustrated in FIG. 1.

The desired number of apparatus 14 may be placed in horizontal alignment along buss bar 26 by merely inserting clips 32 in grooves 28 and male connector plugs 38 in female outlet plugs 36. The housing 16 is also provided with a female outlet plug 40 located in approximately the center of top side wall 16*c*, which is also adapted to receive male connector plug 38. Thus, the desired number of apparatus 14 may be placed in vertical alignment, with respect to connection bars 22, and horizontal alignment, with respect to buss bar 26, and incorporated into the system 12 by inserting clips 32 into grooves 28 and male connector plugs 38 into female outlet plugs 40. The invention lighted display panel system 12 thus permits the coordinated assembly of an array of apparatus 14 in a compact area.

The lighted display apparatus 14 is shown in greater detail in FIG.'S 4–6. A plurality of transformers 42*a*, 42*b*, 42*c*, and 42*d* are appropriately secured to the rear wall 16*e* within the cavity 18 defined by housing 16. Transformers 42*a*, 42*b*, 42*c*, and 42*d* transfer electrical energy received by apparatus 14 through male connector plugs 38 to fluorescent bulbs or tubes 44*a*, 44*b*, 44*c*, and 44*d* respectively. Bulbs 44*a*, 44*b*, 44*c*, and 44*d* are secured within cavity 18 by a pair of opposed contact clips 46*a*, 46*b*, 46*c*, and 46*d*, respectively, which are secured to the inside of top side wall 16*c* and bottom side wall 16*d*. Contact clips 46*a*, 46*b*, 46*c*, and 46*d* are adapted to permit the flow of power from transformers 42*a*, 42*b*, 42*c* and 42*d*, respectively, to bulbs 44*a*, 44*b*, 44*c*, and 44*d*, respectively, through appropriate wires, such as 48*d* shown in FIG. 5.

Figure 4:
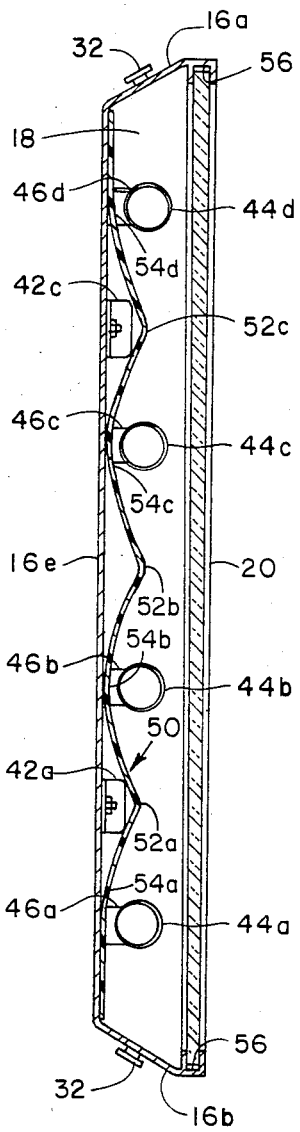
FIG. 4 is a cross sectional view of the invention lighted display panel apparatus taken along section lines 4—4 of FIG. 2.

As illustrated in FIG. 4, an undulant reflector 50 is located within housing cavity 18 between bulbs 44*a*, 44*b*, 44*c*, and 44*d*, and transformers 42*a*, 42*b*, 42*c*, and 42*d*, respectively. Reflector 50 is preferably opaque and has a plurality of peaks 52*a*, 52*b*, and 52*c*, and valleys 54*a*, 54*b*, 54*c*, and 54*d*, which extend the length of housing 16 from top side wall 16*c* to bottom side wall 16*d*. Transformers 42*a*, 42*b*, 42*c*, and 42*d* are preferably located beneath the respective peaks 52*a* and 52*c*, respectively, adjacent to side walls 16*b* and 16*a*, respectively. Furthermore, bulbs 44*b* and 44*c* are preferably located within the valleys 54*b* and 54*c*, respectively defined by peaks 52*a*, 52*b*, and 52*c* of reflector 50. Bulb 44*a* is located within the valley 54*a* defined by peak 52*a* and angled side wall 16*b*. Bulb 44*d* is located within the valley defined by peak 52*c* and side wall 16*a*.

In the preferred embodiment, undulant reflector 50 is covered with aluminum foil to permit the light from bulbs 44*a*, 44*b*, 44*c*, and 44*d* to reflect off the dull side of the foil through lens 20. Lens 20 is preferably a Duratran lens manufactured by Kodak, or a lens of similar quality, having a transparency face mounted on the side thereof facing cavity 18. In the preferred embodiment, bulb 44*a* is located approximately three inches from side wall 16*b* bulb 44*b* is located approximately six inches from bulb 44*a*, bulb 44*c* is located approximately six inches from bulb 44*b*, bulb 44*d* is located approximately six inches from bulb 44*c*, and bulb 44*d* is located approximately three inches from side wall 16*a*.

Figure 5:
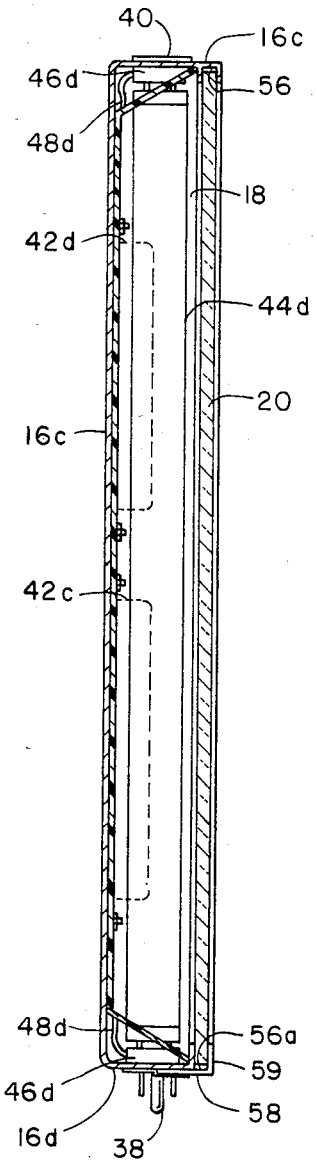
FIG. 5 is a cross sectional view of the invention lighted display panel apparatus taken along section lines 5—5 of FIG. 2.

As illustrated in FIG. 4, lens 20 is adapted to cover cavity 18 and be received within a groove or lip 56 located along the forward perimeter of side walls 16*a*, 16*b*, and top side wall 16*c*. The perimeter of lens 20 is thus adapted to be received within groove 56, thereby securing lens 20 to housing 16 and covering cavity 18. As illustrated in FIG. 5 and FIG. 6, bottom side wall 16*d* includes a hinge member 58 having a lip 59 which, in combination with bottom side wall 16*d*, form a groove 56*a* for receiving the perimeter of lens 20 when hinge member 58 is in a closed position, as illustrated in FIG. 5. As illustrated in FIG. 6, hinge member 58 and bottom side wall 16*d* are provided with matching hook and loop fastener means, such as that sold under the trademark Velcro, to permit the secure closure of hinge member 58. Lens 20 may thus be removably secured to housing 16 and thereby cover cavity 18 by sliding the perimeter of lens 20 within groove 56 and securing hinge member 58 in the closed psoition.

While the invention lighted display panel system and method of assembling same has been described in connection with the preferred embodiment, it is not intended to limit the invention to the particular forms set forth, but on the contrary, it is intended to cover such alternatives, modifications, and equivalents as may be included within the spirit and scope of the invention as defined by the intended claims.

I claim:

1. A method of assembling an illuminated display panel system, comprising the steps of:

inserting and attaching ends of at least two connection rods in an electrical bus bar, said bus bar having a plurality of electrical connectors and a plurality of orifices within which to receive said ends of said connection rods;

sliding a hollow connection bar over said connection rods, said connection bar being adapted to be connected to a side of at least two illuminated display panels, each of said panels having electrical connectors on either end thereof and a cavity therein within which to receive a plurality of fluorescent bulbs and an undulant reflector, each of said panels including means for securing a lens thereto to thereby cover said cavity and means for securing said bulbs within said cavity between waves in said undulant reflector intermediate to said reflector and said lens; and attaching at least two of said panels to said connector bar in horizontal alignment parallel to said bus bar and with at least one of said electrical connectors on each of said panels electrically connected to said bus bar.

2. A method of assembling an illuminated display panel system, comprising the steps of:

inserting and attaching ends of at least two connection rods in an electrical bus bar, said bus bar having a plurality of electrical connectors and a plurality of orifices within which to receive said ends of said connection rods;

sliding a hollow connection bar over each of said connection rods, said connection bar being adapted to be connected to a side of at least two illuminated display panels, each of said panels having a cavity therein within which to receive a plurality of fluorescent bulbs and an undulant reflector, each of said panels including means for securing a lens thereto to thereby cover said cavity and means for securing said bulbs within said cavity between waves in said undulant reflector intermediate to said reflector and said lens;

attaching at least two of said panels to at least one of said connection bars in horizontal alignment parallel to said bus bar and electrically connected to said bus bar; and attaching at least two additional panels to said connection bar in horizontal alignment parallel to said buss bar, said additional panels being in vertical alignment with and electrically connected to the other panels.

* * * * *